US005284446A

United States Patent [19]

Yu

[11] Patent Number: 5,284,446

[45] Date of Patent: Feb. 8, 1994

[54] SOCKET ASSEMBLY

[76] Inventor: Kuang-Shih Yu, 10F, No. 546, Min-Chuan E. Rd., Taipei City, Taiwan

[21] Appl. No.: 40,476

[22] Filed: Mar. 31, 1992

[51] Int. Cl.[5] ..... H01R 4/24

[52] U.S. Cl. ..... 439/409

[58] Field of Search ..... 439/389–425

[56] References Cited

U.S. PATENT DOCUMENTS 4,781,616 11/1988 Yu ..... 439/409

4,874,329 10/1989 Yu ..... 439/409

*Primary Examiner*—Joseph H. McGlynn

*Attorney, Agent, or Firm*—McGlew & Tuttle

[57] ABSTRACT

A socket assembly includes: a non-conductive body with an L-shaped recess that extends from a top end to one side of a middle portion of the body; first and second conducting pieces separately fixed on the body and respectively having a piercing terminal portion; and an L-shaped coupling member connected pivotally to the body and which conforms with the recess so as to make close engagement therewith. The coupling member receives two electrical cords therein while permitting the electrical cords to be exposed in registry with the conducting pieces. The coupling member is rotatable to press the electrical cords against the conductive pieces so that the piercing terminal portions may be inserted into the electrical cords to achieve electrical connection. The first conducting piece has a bottom end which is secured to the body by a rivet. The second conducting piece has a first end formed with a resilient U-shaped insert portion and a second end formed with an L-shaped bend. The U-shaped insert portion is fitted in one of two insert holes formed in a bottom of the recess at the top end of the body, and the second end of the second conducting piece is pressed downward so as to pivot about the U-shaped insert portion and permit insertion of the L-shaped bend in the other one of the insert holes to mount the second conducting piece on the body.

1 Claim, 3 Drawing Sheets

SOCKET ASSEMBLY

BACKGROUND OF THE INVENTION

1. Field of the Invention

The invention relates to a socket assembly, more particularly to an improved socket assembly which has a conducting piece that can be assembled easily on a non-conductive body without the need for a specially designed tool.

2. Description of the Related Art

U.S. Pat. No. 4,781,616 by the applicant discloses a socket assembly which includes: a non-conductive body that has an L-shaped recess provided in a middle portion; a pair of differently constructed conducting pieces fixed separately on the conductive body; an L-shaped coupling member which conforms with the L-shaped recess so as to make close engagement therewith; and a pair of piercing terminal members disposed symmetrically on a reverse surface of the coupling member in conjunction with the conducting pieces. The coupling member is rotatable so that the piercing terminal members may be inserted into a pair of electrical cords, thereby achieving quick and convenient electrical connection without the use of screws.

U.S. Pat. No. 4,874,329, also by the applicant, is an improvement of U.S. Pat. No. 4,781,616. U.S. Pat. No. 4,874,329 discloses a socket assembly which has a construction simpler than that of the previously described socket assembly and which includes: a screwshell for holding an electric lamp bulb; an insulating plate positioned on top of the screwshell; a positive terminal member which is disposed in the screwshell and which has one end that extends through the top of the screwshell; a non-conductive body provided with an L-shaped recess in a middle portion and connected fixedly to the screwshell at a lower end by a plurality of rivet pins; two conducting pieces which are disposed on the non-conductive body and which have a piercing terminal portion connected electrically to a respective one of the screwshell and the positive terminal member; an L-shaped coupling member which is connected pivotally to the non-conductive body and which conforms with the L-shaped recess so as to make close engagement therewith, the coupling member having a chamber formed in a horizontal portion thereof, an opening formed at a juncture between horizontal and vertical portions thereof, and an aperture formed in the horizontal portion in communication with the chamber and in registry with the piercing terminal portions of the conducting pieces, two electrical cords extending into the chamber via the opening and being exposed to the conducting pieces; and a retaining means for retaining the coupling member within the L-shaped recess of the non-conductive body. As with the previously described socket assembly, the coupling member is rotatable so that the piercing terminal portions of the conducting pieces may be inserted into the electrical cords, thereby achieving quick and convenient electrical connection without the use of screws.

The main drawback of the socket assembly disclosed in U.S. Pat. No. 4,874,329 is as follows:

Referring to FIG. 1, one of the conducting pieces (3') has a lower end which is secured on the non-conductive body (1') by means of a rivet (T'). A specially designed clamping tool (not shown) is required to drive the other one of the conducting pieces (4') into the non-conductive body (1') so as to secure the conducting piece (4') on the latter. This can cause some inconvenience when the socket assembly is manufactured.

SUMMARY OF THE INVENTION

Therefore, the objective of the present invention is to provide an improved socket assembly which has a conducting piece that can be assembled easily on a non-conductive body without the need for a specially designed tool.

Accordingly, the preferred embodiment of a socket assembly of the present invention comprises: a screwshell for holding an electric lamp bulb; an insulating plate positioned on top of the screwshell; a positive terminal member which is disposed in the screwshell and which extends through a top end of the screwshell; a non-conductive body provided with an L-shaped recess in a middle portion and connected fixedly to the screwshell at a lower end, said recess extending from a top end to one side of the non-conductive body; first and second conducting pieces disposed on the non-conductive body, each of the first and second conducting pieces having a piercing terminal portion connected electrically to a respective one of the screwshell and the positive terminal member, said first conducting piece having a bottom end which is secured to the non-conductive body by a rivet; and an L-shaped coupling member which is connected pivotally to the non-conductive body and which conforms with the recess so as to make close engagement therewith, said coupling member having an accommodating means therein for receiving two electrical cords while permitting the electrical cords to be exposed in registry with the conducting pieces, said coupling member being rotatable to press the electrical cords against the conductive pieces so that the piercing terminal portions of the conducting pieces may be inserted into the electrical cords to achieve electrical connection. The recess has a bottom which is formed with two spaced insert holes at the top end of the non-conducting body. The second conducting piece has a first end formed with a resilient U-shaped insert portion and a second end formed with an L-shaped bend. The U-shaped insert portion is fitted in one of the insert holes, and the second end of the second conducting piece is pressed downward so as to pivot about the U-shaped insert portion and permit insertion of the L-shaped bend in a remaining one of the insert holes when mounting the second conducting piece on the non-conductive body.

BRIEF DESCRIPTION OF THE DRAWINGS

Other features and advantages of the present invention will become apparent in the following detailed description of the preferred embodiment, with reference to the drawings, of which.

DETAILED DESCRIPTION OF THE PREFERRED EMBODIMENT

Figure 2:
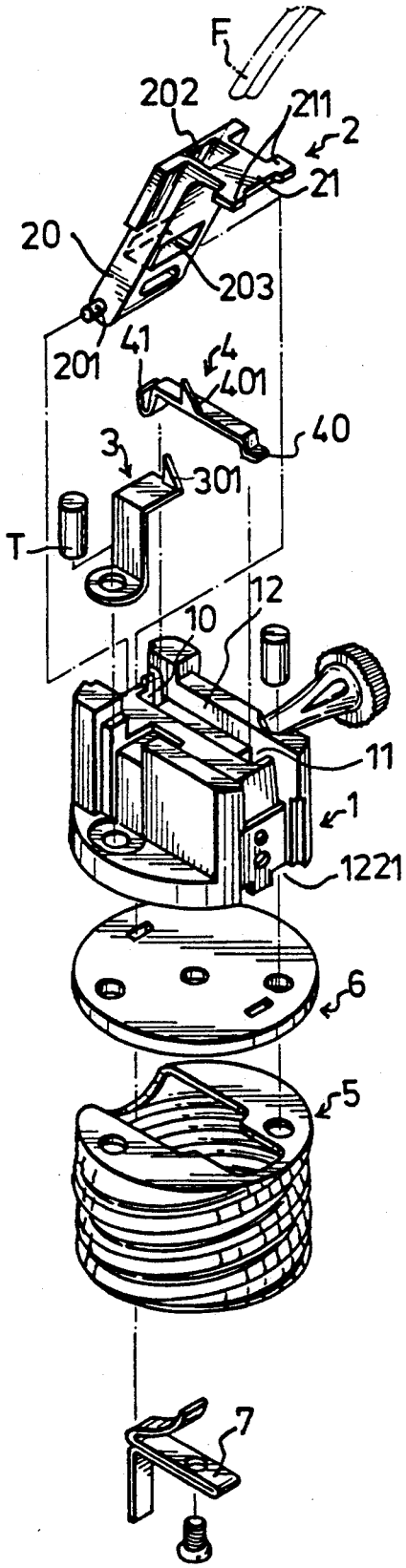
FIG. 2 is an exploded view of the preferred embodiment of a socket assembly according to the present invention.

Referring to FIG. 2, the preferred embodiment of a socket assembly according to the present invention is shown to comprise a non-conductive body (1), a coupling member (2), positive and negative conducting pieces (3, 4), a screwshell (5), an insulating plate (6) and a positive terminal member (7). The socket assembly of the present invention is very similar to that disclosed in U.S. Pat. No. 4,874,329. The main difference between the two socket assemblies resides mainly in the configuration of the negative conducting piece (4).

The screwshell (5) is used to hold an electric lamp bulb. The insulating plate (6) is positioned on top of the screwshell (5). The positive terminal member (7) is disposed in the screwshell (5) and has one end that extends through the top of the screwshell (5). The non-conductive body (1) is formed with an L-shaped recess (12) in a middle portion and is connected fixedly to the screwshell (5) at a lower end. The L-shaped recess (12) extends from a top end to one side of the non-conductive body (1). The positive and negative conducting pieces (3, 4) are disposed on the non-conductive body (1) and are each formed with a triangular piercing terminal portion (301, 401) that is connected electrically to a respective one of the screwshell (5) and the positive terminal member (7).

The coupling member (2) is L-shaped so as to conform with the L-shaped recess (12) in order to make close engagement therewith. The coupling member (2) has a horizontal portion (20) and a vertical portion (21). The horizontal portion (20) is formed with a pair of pivot projections (201) for connecting pivotally the coupling member (2) to the non-conductive body (1). The vertical portion (21) is formed with a retaining unit for retaining the coupling member (2) within the L-shaped recess (12) of the non-conductive body (1). The horizontal portion (20) is further formed with an accommodating means therein to receive two electrical cords (F) while permitting the electrical cords (F) to be exposed in registry with the conducting pieces (3, 4). The accommodating means includes a chamber (202) in the horizontal portion (20) and formed with an opening at a juncture between the horizontal and vertical portions (20, 21). An aperture (203) is formed in the horizontal portion (20) in communication with the chamber (202) and in registry with the piercing terminal portions (301, 401) of the conducting pieces (3, 4). The electrical cords (F) extend into the chamber (202) via the opening and are thus exposed to the conducting pieces (3, 4).

Figure 3:
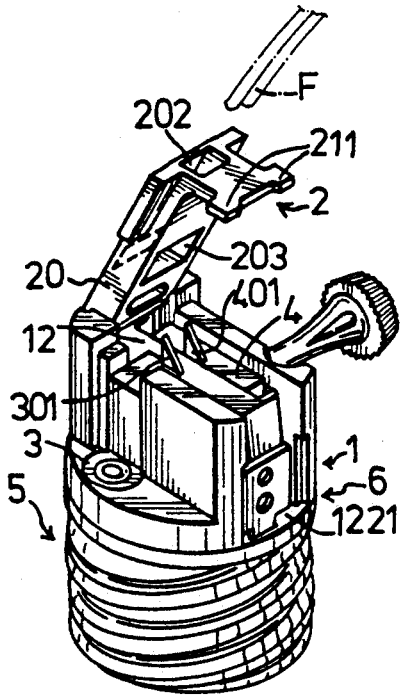
FIG. 3 is an assembled perspective view of the preferred embodiment.
Figure 4:
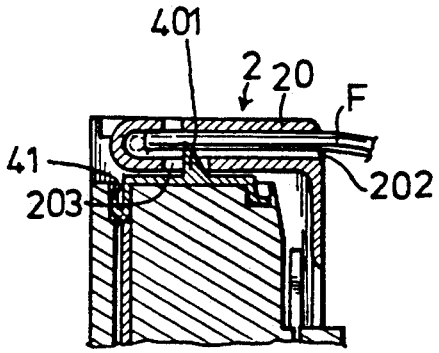
FIG. 4 is a sectional view showing how a conducting piece of the preferred embodiment is mounted on a non-conductive body in accordance with the present invention.

Referring to FIGS. 3 and 4, when the coupling member (2) is rotated so as to engage the L-shaped recess (12) of the non-conductive body (1), the electrical cords (F) are pressed against the conducting pieces (3, 4) such that the piercing terminal portions (301, 401) of the conducting pieces (3, 4) pierce into a respective one of the electrical cords (F), thereby achieving quick and convenient electrical connection without the use of screws.

The vertical portion (21) is formed with end flanges (211) which serve as the retaining unit for retaining the coupling member within the L-shaped recess (12) of the non-conducting body (1). The end flanges (211) are engaged closely within a retaining portion (1221) of the recess (12).

Figure 1:
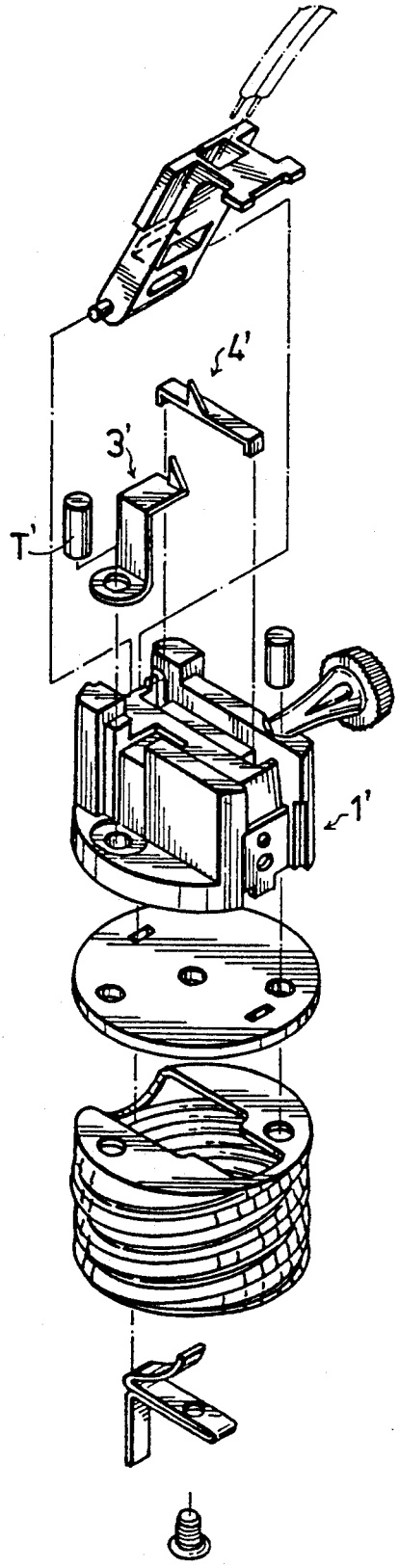
PRIOR ART FIG. 1
FIG. 1 is an exploded view of a socket assembly disclosed in U.S. Pat. No. 4,874,329 by the applicant.

As with the conventional socket assembly shown in FIG. 1, the positive conducting piece (3) has a lower end which is secured on the non-conductive body (1) by means of a rivet (T). The L-shaped recess (12), however, has a bottom which is formed with two spaced insert holes (10, 11) at the top end of the non-conducting body (1). The negative conducting piece (4) has a first end formed with a resilient U-shaped insert portion (41) and a second end formed with an L-shaped bend (40). When mounting the negative conducting piece (4) on the non-conductive body (1), the U-shaped insert portion (41) is initially fitted in one of the insert holes (10). The second end of the negative conducting piece (4) is then pressed downward so as to pivot about the U-shaped insert portion (41) and permit insertion of the L-shaped bend (40) in the remaining one of the insert holes (11).

It has thus been shown that the modifications introduced in the present invention obviate the need for a specially designed tool when mounting the negative conducting piece (4) on the non-conductive body (1). The objective of the present invention is thus achieved.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

I claim:

1. A socket assembly, including a screwshell for holding an electric lamp bulb, an insulating plate positioned on top of said screwshell, a positive terminal member which is disposed in said screwshell and which extends through a top end of said screwshell, a non-conductive body provided with an L-shaped recess in a middle portion and connected fixedly to said screwshell at a lower end, said recess extending from a top end to one side of said non-conductive body, first and second conducting pieces disposed on said non-conductive body, each of said first and second conducting pieces having a piercing terminal portion connected electrically to a respective one of said screwshell and said positive terminal member, said first conducting piece having a bottom end which is secured to said non-conductive body by a rivet, and an L-shaped coupling member which is connected pivotally to said non-conductive body and which conforms with said recess so as to make close engagement therewith, said coupling member having an accommodating means therein for receiving two electrical cords while permitting said electrical cords to be exposed in registry with said conducting pieces, said coupling member being rotatable to press said electrical cords against said conductive pieces so that said piercing terminal portions of said conducting pieces may be inserted into said electrical cords to achieve electrical connection, wherein the improvement comprises:

said recess having a bottom which is formed with two spaced insert holes at said top end of said non-conducting body, and said second conducting piece having a first end formed with a resilient U-shaped insert portion and a second end formed with an L-shaped bend;

said U-shaped insert portion being fitted in one of said insert holes, and said second end of said second conducting piece being pressed downward so as to pivot about said U-shaped insert portion and permit insertion of said L-shaped bend in a remaining one of said insert holes when mounting said second conducting piece on said non-conductive body.

* * * * *

UNITED STATES PATENT AND TRADEMARK OFFICE

CERTIFICATE OF CORRECTION

PATENT NO. : 5,284,446

DATED : February 8, 1994

INVENTOR(S) : Kuang-Shih Yu

It is certified that error appears in the above-identified patent and that said Letters Patent is hereby corrected as shown below:

On the Title Page, Item [22], please correct the filing date to read --[22] Filed: March 31, 1993--.

Signed and Sealed this

Twelfth Day of July, 1994

*Attest:*

Bruce Lehman

BRUCE LEHMAN

*Attesting Officer*

*Commissioner of Patents and Trademarks*